United States Patent [19]

Kuroda

[11] Patent Number: 4,991,269

[45] Date of Patent: Feb. 12, 1991

[54] CLIP

[76] Inventor: Akitada Kuroda, 2-13-4 Mitake Togo-Cho, Aichi-Gun, Aichi-Ken, Japan, 470-01

[21] Appl. No.: 25,758

[22] Filed: Mar. 13, 1987

[51] Int. Cl.[5] ..... B42F 1/00

[52] U.S. Cl. ..... 24/67.11; 24/67.9; 24/545

[58] Field of Search ..... 24/67 R, 67.9, 67.11, 24/67.3, 3 J, 3 H, 545, 563, 30.5 S

[56] References Cited

U.S. PATENT DOCUMENTS

| | | | |
|---|---|---|---|
| 389,918 | 9/1888 | Bennett | 24/563 |
| 2,329,974 | 9/1943 | Bennett | 24/67.11 |
| 2,729,868 | 1/1956 | Manning | 24/545 |
| 3,296,673 | 1/1967 | Kirkpatrick | 24/67 R |
| 3,348,272 | 10/1967 | Germani | 24/563 |

FOREIGN PATENT DOCUMENTS

| | | | |
|---|---|---|---|
| 194345 | 12/1983 | Japan . | |
| 006477 | 1/1984 | Japan . | |
| 24607 | of 1915 | United Kingdom | 24/67.3 |

*Primary Examiner*—Victor N. Sakran

[57] ABSTRACT

According to the present invention a spring clip comprises a holding portion No. 1 made from a resilient strip with one or more than one slits and stamped portion therein permitting turn over motion thereof and another holding portion No. 2 opposed to the holding portion No. 1. In contrast with a conventional spring clip, the disclosed clip is compact, since it has no levers pivoted to the leading ends of the holding portion or extended from the holding portions. The disclosed clip is advantageous, since the leading ends are wide enough to clip sheets firmly.

3 Claims, 5 Drawing Sheets

CLIP

BACKGROUND OF THE INVENTION

The present invention relates to a spring clip for holding sheets of paper or the like. There have been devised and widely used spring clips of the type in which a pair of holding edges or lips thereof are resiliently pressed each other. In order to open the spring clip or to move the lips away from each other, the spring clip is provided with a pair of levers pivoted to the edges or extended from the holding portion. One has inconvenience because the levers are projected outwardly or folded over the sheets of paper beyond the leading edges by a relatively great distance. The divised type of clip is shown in Japan Utility Model Application Showa No. 58-194345(1983) [Laying Open Showa No. 60-101182]. As disclosed in the Utility Model, the holdling edges can be opened without the levers by one of the holding portion being turned over. This type of clip is disadvantageous, since the holding portions extend over the sheets by a great distance. This type of clip is not stable when holding sheets, because the contact point of the edges with the sheets is limited to a small area.

SUMMARY OF THE INVENTION

The present invention provides a spring clip for holding sheets of paper or the like which is capable of being opened without levers and of gripping the sheets firmly with widely extending portion along the edges of the sheets. According to the present invention the spring clip comprises a holding portion No. 1 made from a resilient strip with at least one slit and stamped portion therein permitting turn over motion thereof and another holding portion No. 2 opposed to the holding portion No. 1. The sheets can be held between the holding portion No. 1 and No. 2 when the edges of the holding portion No. 1 turns inwardly, and the sheets can be released when the edges of the holding portion No. 1 turns outwardly.

DESCRIPTION OF THE PREFERRED EMBODIMENTS

Figure 2:
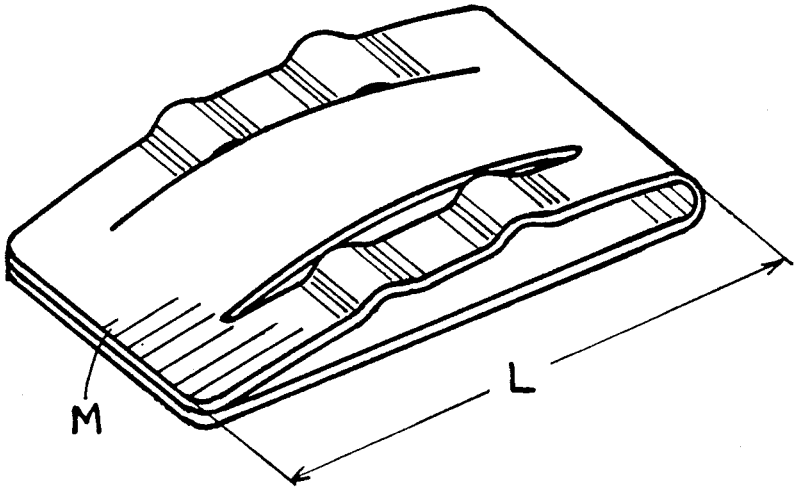
FIG. 2 is a perspective view of a prior art clip.

Referring first to FIG. 2, there is shown a prior art spring clip which has disadvantages, since the spring clip extends over sheets of paper (L is relatively long). In addition, the sheets of paper easily slip off, since the contact portion of the spring clip with the sheets of paper (M) is limited to small area.

Figure 1:
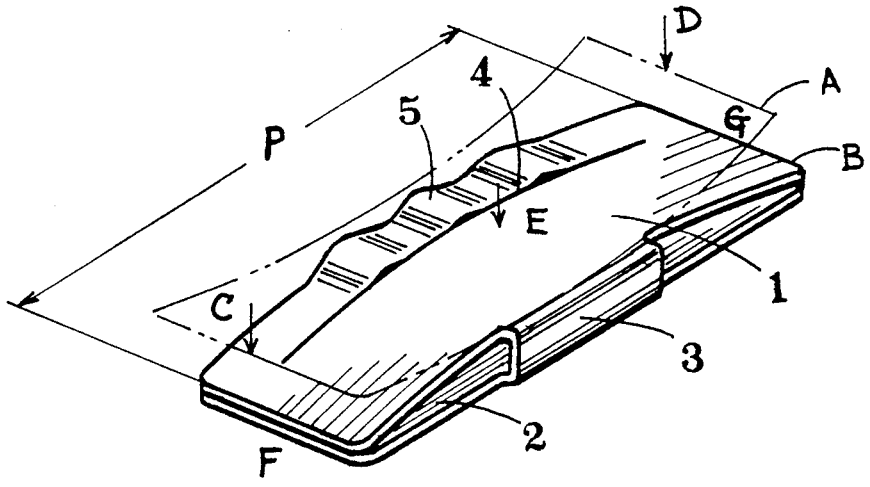
FIG. 1 is a perspective view of the first embodiment.
Figure 3:
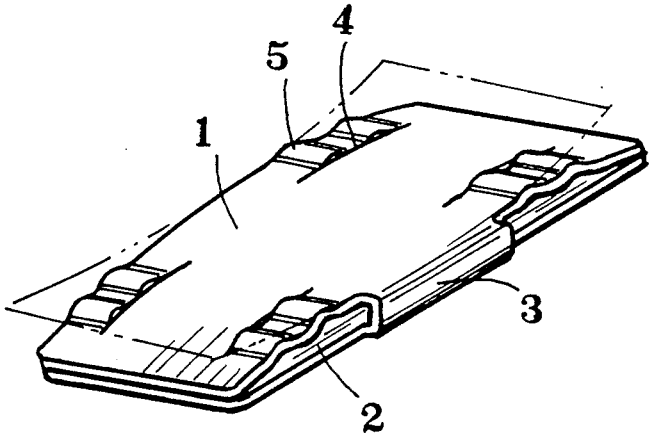
FIGS. 3 through 8 are perspective views, respectively, of the second through seventh embodiments of the present invention.
Figure 4:
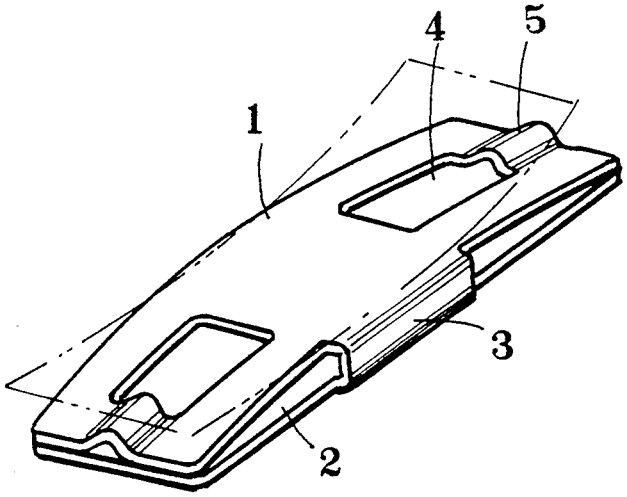

Referring to FIG. 1, there is shown a spring clip of a first embodiment of the present invention. The spring clip of the first embodiment is made from an integral blank strip of a resilient material such as spring steel or plastics and formed by bending the strip, with a holding portion 1, another holding portion 2 and a side wall portion 3 bridging the side ends of the holding portion 1 and the holding portion 2. The holding portion 1 has a slit 4 which extends substantially parallel to the side wall portion 3 and has a wave-shaped portion 5 adjacent to the slit 4. The holding portion 1 is able to be turned over from A to B when the points C,D are pressed, and also B to A when the point E is pressed as described in FIG. 1. The spring clip does not conceal the sheet, since the spring clip holds the sheets along the edge thereof and does not extend over the sheets. The spring clip also aids in preventing slippage of the sheets from the spring clip, since there are two contact portions F,G of the spring clip with the sheets which are located at a relatively long distance(P). In the FIG. 3 and FIG. 4 are shown other embodiments of the present invention which are substantially similar to the first embodiment described above with reference to FIG. 1 except the shape of the slits 4 and the wave-shaped portion 5.

Figure 5:
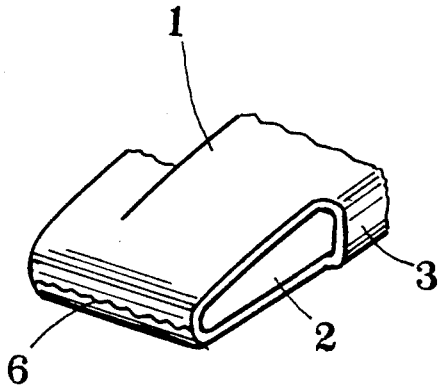
Figure 6:
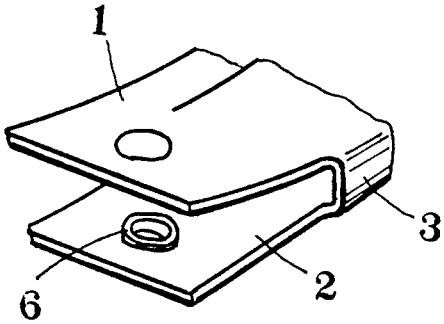
Figure 7:
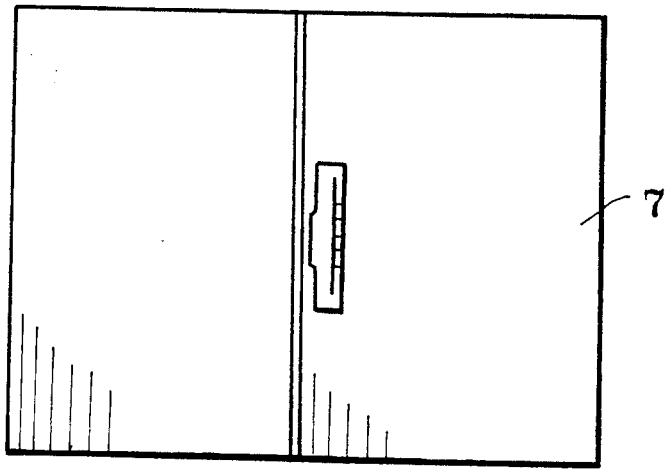
Figure 8:
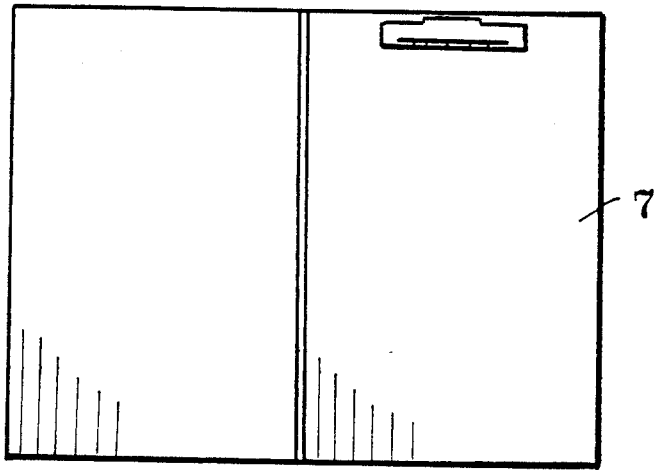

In the FIG. 5 and FIG. 6 are shown other embodiments of the present invention which are similar to above embodiments except that they are provided with means 6 for preventing slippage of the sheets from the spring clip. In FIG. 7 and FIG. 8 are shown paper holders with the holding portions described above and a backing board 7.

Although illustrative embodiments of the invention have been described in detail with reference to the accompanying drawings, it is to be understood that the invention is not to be limited to those precise embodiments and that various changes in shapes, size or other modifications may be effected therein by one skilled in the art without departing from the scope of spirit of the invention.

I claim:

1. A spring clip comprising:

a holding portion (No.1) made from resilient strip with at least one slit therein and at least one stamped portion near said slits, permitting turn over motion thereof;

a holding portion (No.2) opposed to said holding portion (No.1);

and a side wall portion which extends substantially parallel to said slits bridging the sides of said holding portion (No.1) and a holding portion (No.2), edges of said holding portion (No.1) being turned inwardly when holding sheets and turned outwardly when releasing sheets.

2. A spring clip of claim 1, wherein:

said holding portion (No.1), said holding portion (No.2) and said side wall portion are formed as one-piece integral unit, and said holding portion (No.1) having one slit extending substantially parallel to the side wall portion and a wave-shaped stamped portion adjacent to said slit.

3. A spring clip of claim 1, wherein:

said holding portion (No.2) is provided with a backing board.

* * * * *